US005202669A

United States Patent [19]

Ishimochi et al.

[11] Patent Number: 5,202,669

[45] **Date of Patent: * Apr. 13, 1993**

[54] DISPLAY CONTROL DEVICE FOR SUPERIMPOSING DATA WITH A BROADCAST SIGNAL ON A TELEVISION SCREEN

[75] Inventors: Haruki Ishimochi, Nikko; Kimio Yamamura, Yaita; Yuji Fukuyama, Yaita; Masato Yanai, Yaita; Satoshi Takahashi, Yaita, all of Japan

[73] Assignee: Sharp Kabushiki Kaisha, Osaka, Japan

[ * ] Notice: The portion of the term of this patent subsequent to Feb. 6, 2007 has been disclaimed.

[21] Appl. No.: 450,166

[22] Filed: Jan. 11, 1990

Related U.S. Application Data

[63] Continuation of Ser. No. 524,866, Aug. 19, 1983, Pat. No. 4,899,139.

[30] Foreign Application Priority Data

| | | | |
|---|---|---|---|
| Aug. 24, 1982 | [JP] | Japan | 57-146573 |
| Aug. 25, 1982 | [JP] | Japan | 57-148399 |
| Aug. 26, 1982 | [JP] | Japan | 57-148542 |
| Aug. 30, 1982 | [JP] | Japan | 57-151341 |

[51] Int. Cl.[5] ..... G09G 1/00

[52] U.S. Cl. ..... 340/721; 340/703; 358/183

[58] Field of Search ..... 340/721, 734, 744, 748, 340/735, 790, 726, 703, 701; 358/903, 22, 183, 149

[56] References Cited

U.S. PATENT DOCUMENTS

| | | | |
|---|---|---|---|
| 3,891,792 | 6/1975 | Kimura | 340/726 |
| 3,903,510 | 9/1975 | Zobel | 340/726 |
| 4,209,832 | 6/1980 | Gilham et al. | 340/721 |
| 4,281,345 | 7/1981 | Wärn | 358/149 |
| 4,309,700 | 1/1982 | Kraemer | 340/726 |
| 4,320,395 | 3/1982 | Meissen et al. | 340/726 |
| 4,342,029 | 7/1982 | Hofmanis et al. | 340/703 |
| 4,346,407 | 8/1982 | Baer et al. | 358/149 |
| 4,425,581 | 1/1984 | Schweppe et al. | 340/721 |
| 4,899,139 | 2/1990 | Ishimochi et al. | 340/721 |

*Primary Examiner*—Jeffery A. Brier

[57] ABSTRACT

A cathode-ray tube control device displays data obtained from a personal computer on the screen of a television receiver in superimposing relation to the picture of a broadcast. Clock pulses are generated, and these are counted in synchronism with the horizontal and vertical synchronizing signals from the television receiver. Display timing signals including horizontal scanning display period signal, horizontal retrace period signal, vertical scanning display period signal, and vertical retrace period signal are delivered in response to the resultant counts. Then, read-out of data to be displayed is controlled in accordance with the produced timing signals, and the read data is displayed on the screen such that it is superimposed on the picture of a television broadcast. If desired, the frequency of the timing signals may be slightly varied so as to scroll said data across the television picture.

1 Claim, 11 Drawing Sheets

FIG.1
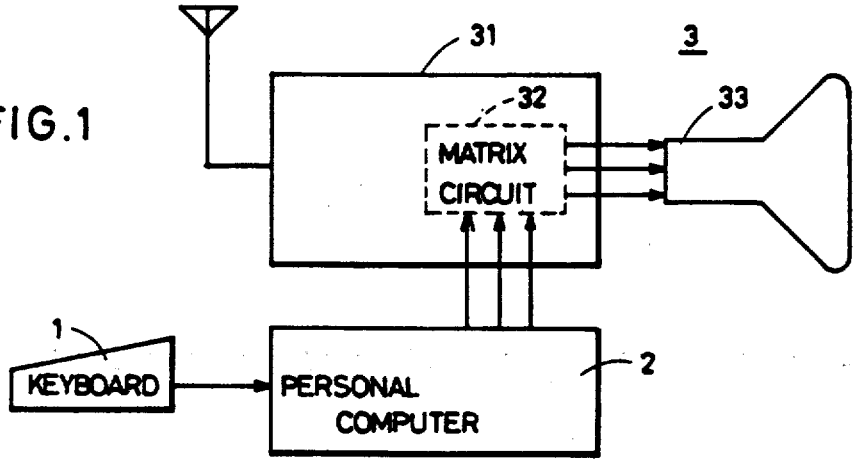
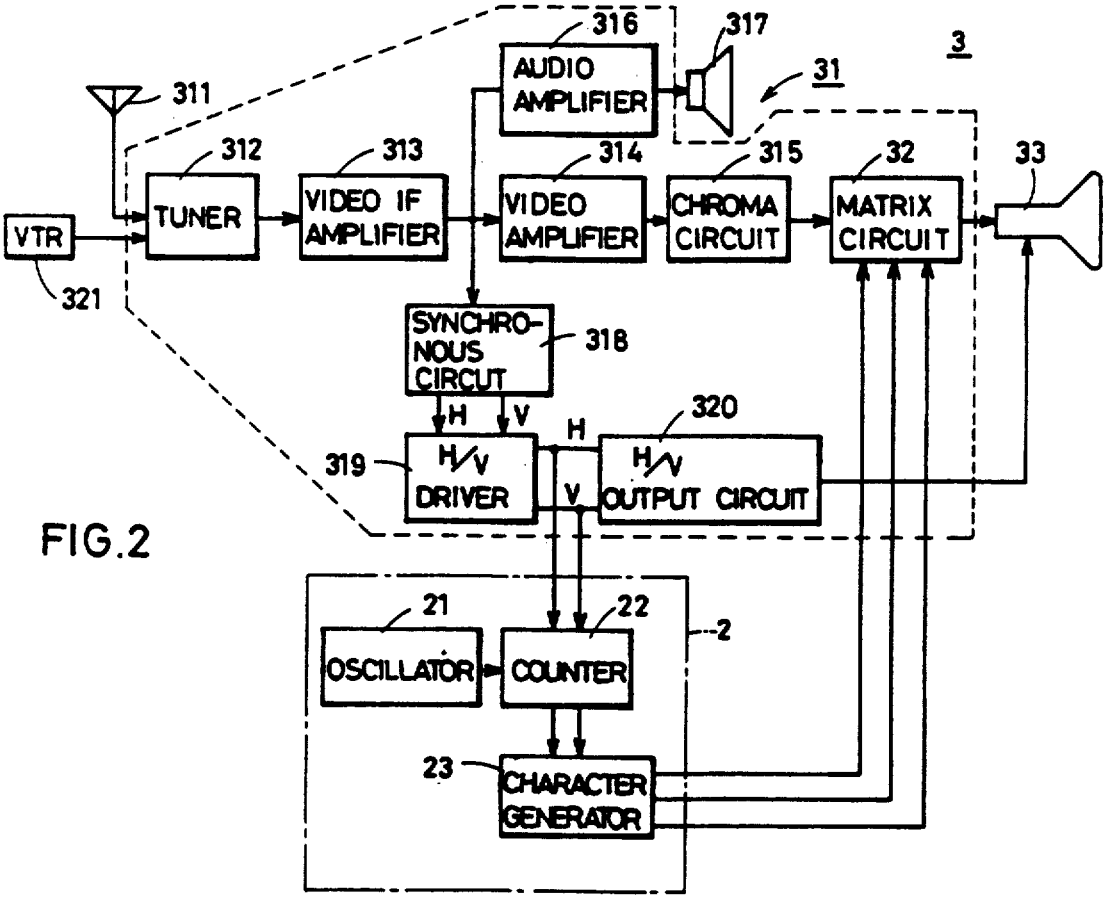
FIG.2

FIG. 6 (b)
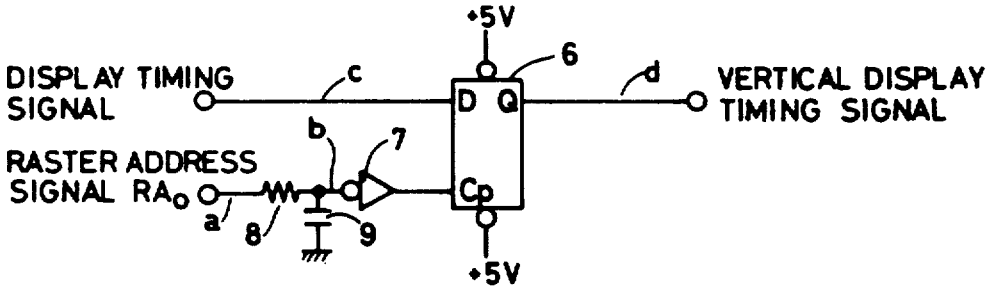
FIG. 7
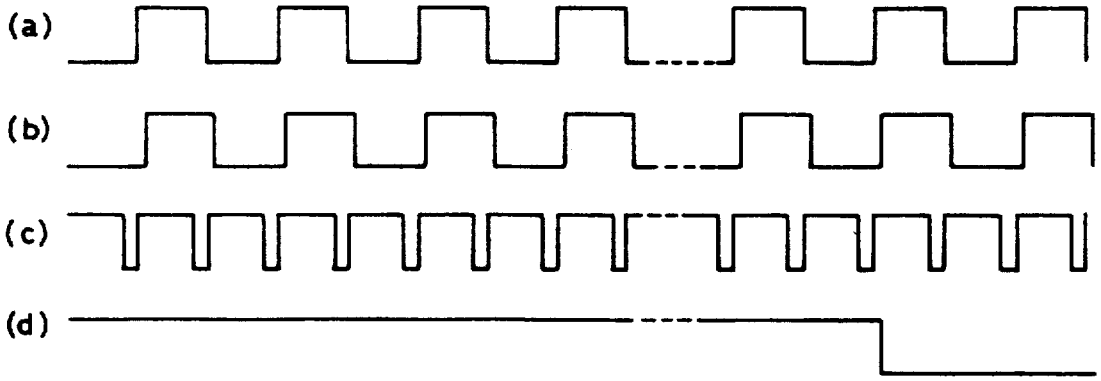
FIG. 8
| INPUT | | | | OUTPUT | |
|---|---|---|---|---|---|
| PRESET | CLEAR | CLOCK | D | Q | $\overline{Q}$ |
| L | H | X | X | H | L |
| H | L | X | X | L | H |
| L | L | X | X | H | H |
| H | H | ↑ | H | H | L |
| H | H | ↑ | L | L | H |
| H | H | L | X | $Q_0$ | $\overline{Q}_0$ |

| SELECT SIGNAL | R | G | B |
|---|---|---|---|
| 0 0 0 | 1 | 0 | 0 |
| 0 0 1 | 0 | 1 | 0 |
| 0 1 0 | 0 | 0 | 1 |

| SELECT SIGNAL | R | G | B |
|---|---|---|---|
| 0 0 0 | 1 | 0 | 0 |
| 0 0 1 | 0 | 1 | 0 |
| 0 1 0 | 0 | 0 | 1 |
| 1 0 0 | 0 | 1 | 1 |
| 1 0 1 | 1 | 0 | 1 |
| 1 1 0 | 1 | 1 | 0 |
| 1 1 1 | 1 | 1 | 1 |

DISPLAY CONTROL DEVICE FOR SUPERIMPOSING DATA WITH A BROADCAST SIGNAL ON A TELEVISION SCREEN

This application is a continuation of copending application Ser. No. 06/524,866, filed on Aug. 19, 1983 now U.S. Pat. No. 4,899,139.

BACKGROUND OF THE INVENTION

The present invention relates to a cathode-ray tube display control device and, more particularly, to a cathoderay tube display control device for connecting a personal computer to a household color television receiver to display desired characters, graphs, and so on upon the screen of the receiver in superimposing or overlapping relation to the picture of a broadcast now presented upon the screen.

Recently, personal computers have been increasingly used in ordinary homes, and it has been attempted to connect a household color television receiver with a personal computer as a CRT display unit to display the data supplied from the computer on it. Unfortunately, such a system is unable to display the data from the computer in overlapping relation to the picture of a television broadcast.

SUMMARY OF THE INVENTION

Accordingly, it is an object of the present invention to provide a CRT control device for connecting a personal computer to a household color television receiver to display the data in the computer on the CRT in superimposing or overlapping relation to the picture of a television broadcast.

Other objects and scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

In one aspect of the present invention, a CRT control device allowing the data in a personal computer to be displayed on the screen of a color television receiver in superimposing or overlapping relation to the picture of a television broadcast includes means for storing the data from the computer; an oscillator means for producing clock signals in synchronism with the horizontal and vertical synchronizing signals from the television receiver and means for delivering timing signals containing horizontal scanning display period, horizontal retrace period, vertical scanning display period, and vertical retrace period signals by counting the clock signals from the oscillator means. The control device also includes means for controlling the read-out of data from the computer depending on the timing signals and for supplying the data to the television receiver.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 1 schematically shows the manner in which a conventional personal computer is connected to a color television receiver;

FIG. 2 is a schematic block diagram of a CRT control device embodying the concept of the present invention;

FIG. 6 (*b*) is a schematic representation of the D flip-flop used in the device of FIG. 6 (*a*);

FIG. 7 is a time chart illustrating the operation of the D flip-flop of FIG. 6 (*b*):

FIG. 8 is a truth table for the D flip-flop of FIG. 6 (*b*);

DETAILED DESCRIPTION OF THE INVENTION

Figure 3:
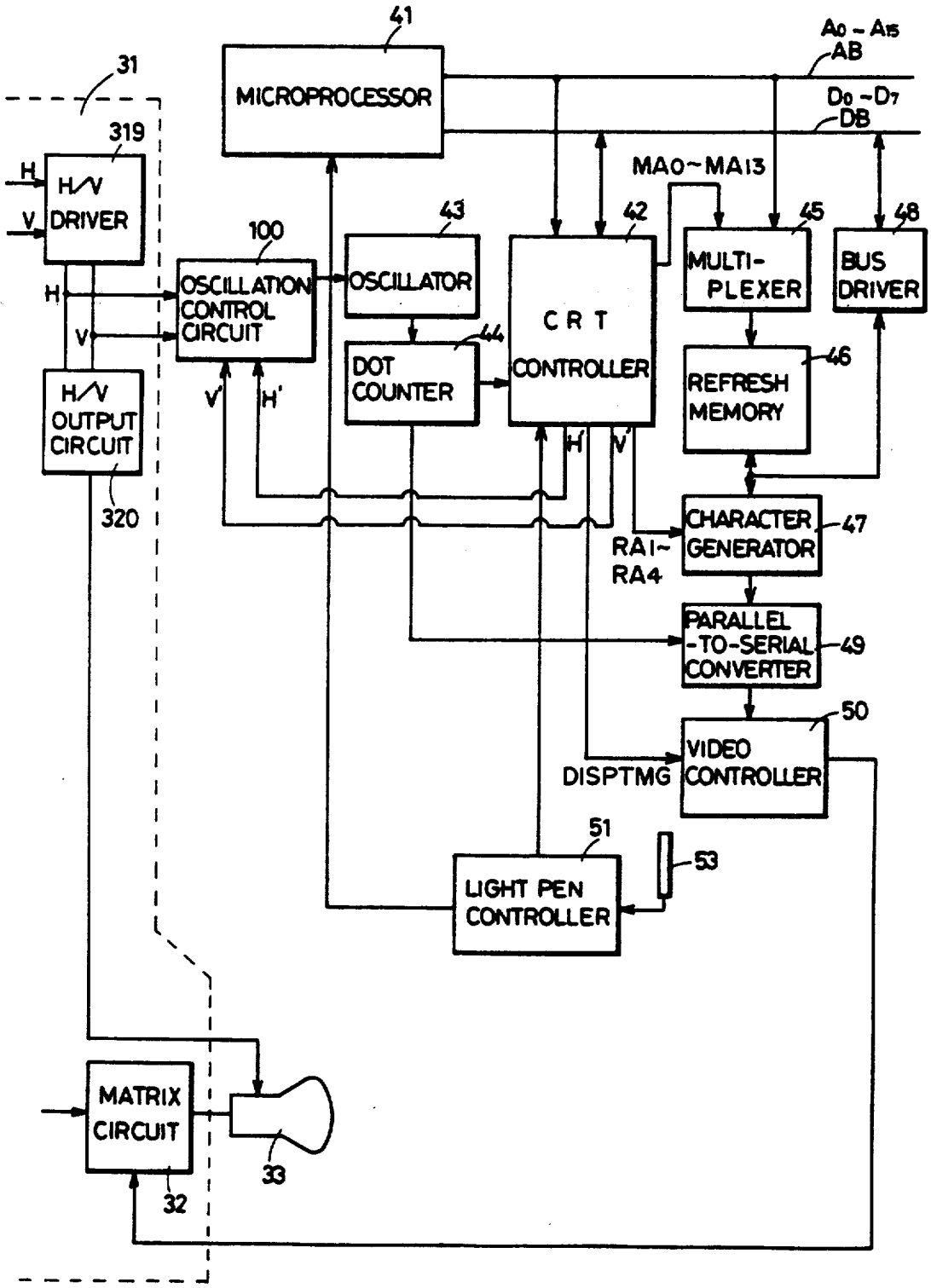
FIG. 3 is a schematic block diagram of another CRT control device using a CRT controller according to the present invention.

Referring to FIG. 1, the manner in which a conventional personal computer is connected to a color television receiver is schematically shown. When data is fed into the personal computer 2 by operating a keyboard 1, red, green, and blue signals which cause the color television receiver 3 to display the data thereon are supplied to the matrix circuit 32 of the television circuit 31 of the television receiver. The red, green, and blue signals are supplied to the cathode ray tube 33 of the receiver via the matrix circuit 32 to display characters, graphs, or the like.

By constructing the CRT display control device in this manner, various visual images such as characters and graphs can be displayed on the television receiver 3 serving as a monitor. The data from the personal computer can be displayed on the screen of the receiver such that the data is superimposed on the picture of a color television broadcast, according to the present invention as described hereinafter.

Referring next to FIG. 2, there is shown a schematic diagram of a CRT display control device embodying the concept of the present invention. In this figure, a television broadcast signal is fed to the tuner 312 from the antenna 311 of color television receiver 3, or a broadcast signal recorded in a video tape recorder (VTR) 321 is directly fed to the tuner 312, as well known in the art. The tuner 312 then delivers a video IF signal to a video IF amplifier 313 which detects the video signal. The video signal is then supplied to CRT 33 via a video amplifier circuit 314, a chroma circuit 315, and a matrix circuit 32. An aural signal is obtained also from the output from the IF amplifier 313 and is fed to a loudspeaker 317 via an audio amplifier 316. A synchronous circuit 318 derives a synchronizing signal from the output from the IF amplifier 313 so that horizontal and vertical synchronizing signals are fed to a horizontal and vertical output circuit 320 via a horizontal and vertical driver circuit 319. The output circuit 320 applies horizontal and vertical output signals to the CRT 33. The horizontal and vertical synchronizing signals delivered from the driver circuit 319 are supplied to a counter 22 incorporated within the computer 2. The counter 22 counts the clock signals coming from the oscillator circuit 21 in synchronism with the horizontal and vertical synchronizing signals and provides the obtained count to a character generator 23 as an address signal. The generator 23 gives red, green, and blue signals to the matrix circuit 32 of the television receiver 3 and so the three primary color signals synchronized with the horizontal and vertical synchronizing signals of the receiver can be provided to the receiver 3. Accordingly, it is possible to display the information from the personal computer on the screen of the color television receiver in a superimposing manner.

FIG. 3 is a schematic block diagram of another CRT control device using a CRT controller in the form of one chip in accordance with the present invention. The components in this figure and also the components in the following figures which function in the same way as those in FIGS. 1 and 2 are denoted by the same reference numerals.

Figure 4:
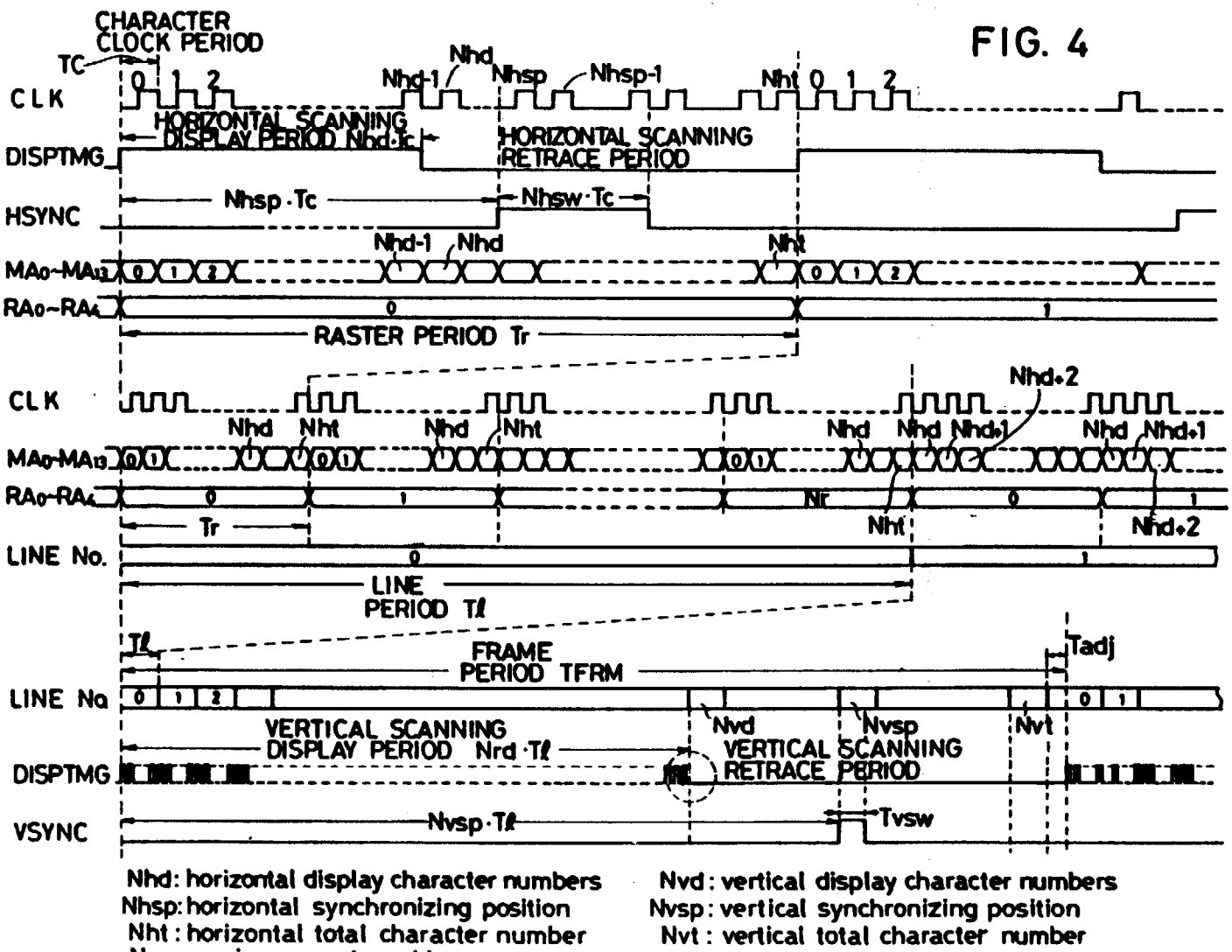
FIGS. 4 and 5 are time charts illustrating the operation timing of the CRT controller of FIG. 3.
Figure 5:
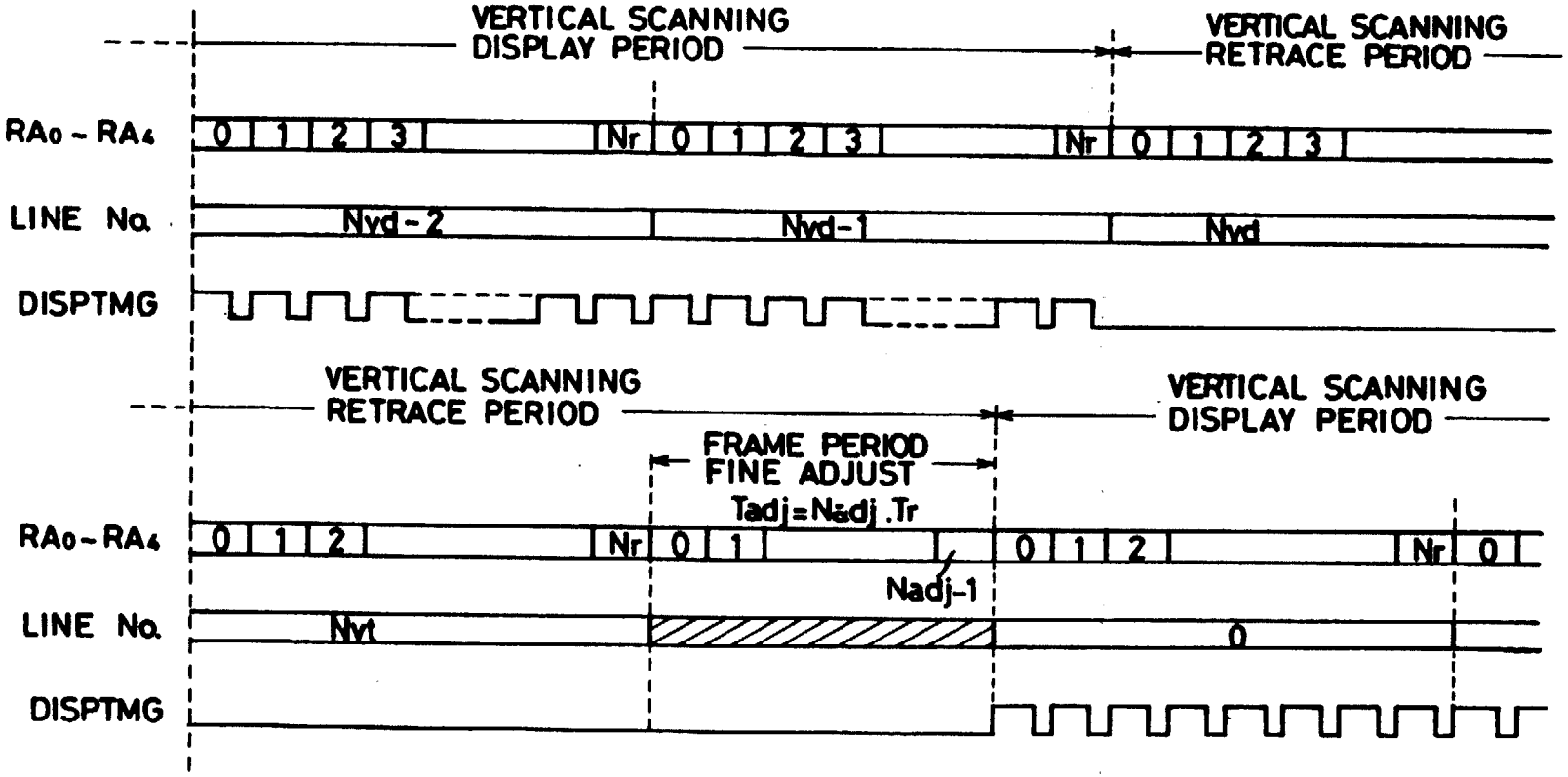

Recently, CRT controllers which are connected between a microprocessor and a CRT display unit and take a form of one chip, such as HD46505S manufactured by Hitachi Ltd., Japan, have been employed to display data on the CRT display unit with relative ease. FIGS. 4 and 5 are time charts showing the operation timings of the CRT controller of FIG. 3.

Referring to FIG. 3, CRT controller 42 in the form of one chip basically functions to deliver memory addresses $MA_0$–$MA_{13}$ to fetch data from a refresh memory 46, to deliver raster address signals $RA_0$–$RA_4$ to a character generator 47 and other devices, to horizontally and vertically synchronize the television circuit 31 of television receiver 3, to display horizontal and vertical retrace periods, to display a cursor on the screen of the CRT 33, and to receive the signal from a light pen 53. The CRT controller 42 includes a set of internal registers, horizontal and vertical timing generator circuits, a linear address generator, a cursor control circuit, and a light pen detector circuit. The controller 42 is connected to a microprocessor 41 through an address bus AB and a data bus DB and operates in synchronism with the clock signals which are supplied from an oscillator circuit 43 to the controller via a dot counter 44 that acts to divide the frequency of the output clocks from the oscillator down to a certain value. The horizontal synchronizing signal H and the vertical synchronizing signal V from the horizontal and vertical driver circuit 319 of the television circuit 31 are compared with the horizontal synchronizing signal H' and the vertical synchronizing signal V', respectively, obtained from the CRT controller 42 in respect of phase within an oscillation control circuit 100, and the output from the oscillator circuit 43 is controlled according to the resultant signals.

The CRT controller 42 also provides the memory address signals $MA_0$–$MA_{13}$ to a multiplexer 45, which is also supplied with address signals $A_0$–$A_{15}$ from the microprocessor 41. The multiplexer 45 selects one out of the address signals and supplies it to the refresh memory 46 which is connected to the data bus DB via a bus driver 48. The CRT controller 42 further gives raster address signals $RA_0$–$RA_4$ to the character generator 47, which stores character data therein and fetches character data in bit parallel form from the associated locations in response to the input signals $RA_0$–$RA_4$. The fetched character data is fed to a parallel-to-serial converter circuit 49, which is also supplied with a timing signal from the dot counter 44 and converts the character data from bit parallel form into bit serial form in response to the timing signal. The data in bit serial form is applied to a video controller 50, which is also supplied with a display timing (DISPTMG) from the CRT controller 42. The controller 50 supplies red, green, and blue signals which constitute character data to the matrix circuit 32 of the television receiver in response to the display timing signals to display the data on the CRT 33. In this way, the information from the computer can be displayed on the screen in superimposing or overlapping relation to the visual images of the television receiver.

The signal delivered by the light pen 53 is applied to a light pen controller 51, which supplies a strobe signal to the CRT controller 42 in response to the input signal and delivers an interrupt signal to the microprocessor 41.

As shown in FIGS. 4 and 5, the display timing signal (DISPTMG) produced from the CRT controller 42 includes horizontal scanning display period, horizontal scanning retrace period, vertical scanning display period, and vertical scanning retrace period portions. The CRT controller permits video signals to be supplied to the CRT 33 when the display timing signal is in high state, that is, only during the horizontal and vertical scanning display periods. Therefore, when the display timing signal assumes a low level state, that is, during the horizontal and vertical scanning retrace periods, no data is displayed on the CRT 33 and no control is exerted over the image display operation. Accordingly, the microprocessor 41 can perform necessary processings during the periods in which the display timing signal is in a low state.

In actuality, however, the horizontal scanning retrace periods in which the display timing signal is in low state are shorter as compared with the processing time of the microprocessor 41 and therefore it is not possible to operate the microprocessor during these periods. On the other hands, the microprocessor can be operated during the vertical scanning retrace periods in which the display timing signal is also in low state, because the periods are longer as compared with the processing time. Thus, the microprocessor 41 can be operated only during the vertical scanning retrace periods. To achieve this, it must be assured that every instant during the desired vertical scanning retrace period the display timing signal is in a low state. For this purpose, a program is produced such that the microprocessor 41 is not operated during any horizontal scanning retrace period when the display timing signal is at low level but will be operated if the signal remains in low level state after the lapse of the period, whereby the microprocessor 41 is locked in step with the vertical scanning retrace periods.

When such a program is utilized, the judgment as to whether it is in a desired vertical scanning retrace period is given after the lapse of a horizontal scanning retrace period and hence the time the microprocessor 41 can operate is each vertical scanning retrace period subtracted by each horizontal scanning retrace period. The result is that the horizontal scanning retrace periods are wasted for the operation of the microprocessor 41.

Figure 6A:
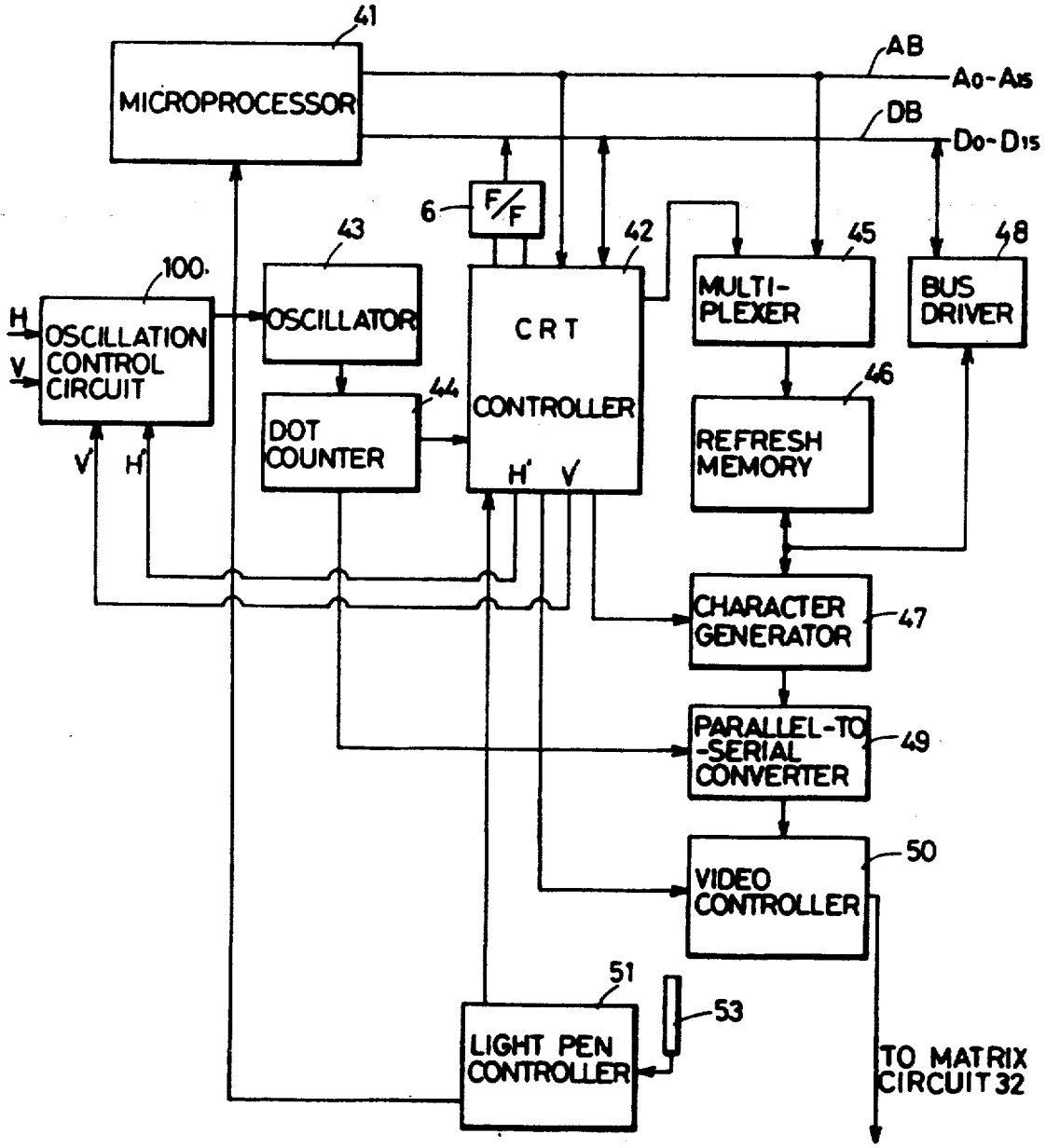
FIG. 6 (*a*) is a schematic block diagram of still another CRT control device of the invention.

In view of the foregoing, the present invention provides another embodiment in which the microprocessor is operated for prolonged periods to enhance its processing efficiency, as described with reference to FIGS. 6 (*a*) and 6 (*b*). FIG. 6 (*a*) is a fragmentary schematic block diagram of the CRT control device of such embodiment, and FIG. 6 (*b*) is a schematic representation of the D flip-flop 6 which is used in this embodiment and triggered by pulses having a positive edge.

In this embodiment, the D flip-flop 6 is used to deliver a vertical display timing signal. The flip-flop 6 has a D input terminal, a clock pulse input terminal, a preset input terminal, and a clear input terminal, the preset and clear terminals being supplied with a voltage of +5 V. Applied to the D input terminal is the display timing signal produced from the aforementioned CRT controller 42 shown in FIG. 3. The raster address signal $RA_0$ produced from the controller 42 is delayed by means of an integrator circuit consisting of a resistor 8 and a capacitor 9 and is then inverted by an inverter 7 before application to the clock pulse input terminal.

FIG. 7 is a time chart illustrating the operation of the D flip-flop of FIG. 6 (*b*), and FIG. 8 is a truth table for the D flip-flop.

Referring next to FIGS. 7 and 8 as well as to FIG. 6 (*b*), the raster address signal $RA_0$ is delayed by means of the integrator circuit made up of the resistor 8 and the capacitor 9, inverted by the inverter 7, and supplied to the D flip-flop 6. Upon the leading edges of the clock pulses provided to the flip-flop 6, the display timing signal is in high level condition because it is in a horizontal scanning display period, resulting in a high level signal from the output terminal of the flip-flop 6. When the horizontal scanning retrace period is replaced by a vertical scanning retrace period, the display timing signal is changed to low level, with the result that the output from the flip-flop drops to low level. Namely, the flip-flop 6 delivers a vertical display timing signal which assumes high level state during the horizontal scanning display and the horizontal scanning retrace periods and assumes low level state during the vertical scanning retrace periods. By supplying the vertical display timing signal to the microprocessor 41, it can immediately judge whether it is a vertical retrace period. Consequently, the microprocessor 41 can be operated for a lengthened period, as compared with the conventional method in which the vertical retrace periods are discerned according to the directions of a program as described above.

As described thus far, in accordance with the present invention, the flip-flop is caused to produce the display timing signal in response to the clock signals having a period substantially equal to the period of the horizontal scanning period signal, so that the vertical retrace period signal can be produced from the output terminal of the flip-flop. The central processing means is capable of effecting its processing operation during the periods in response to the vertical retrace period signal. Accordingly, the microprocessor is able to display data on the CRT in response to the vertical retrace period signal, thus permitting the data from the personal computer to be superimposed on the visual images of the television receiver. Although the D flip-flop 6 is disposed outside the CRT controller 42, it is also possible to incorporate the D flip-flop in the controller.

As can be understood from FIG. 4, the clock signals provided to the CRT controller 42 from the dot counter 44 define one character, while the timing signal fed from the dot counter 44 to the parallel-to-serial converter circuit 49 defines one dot. That is, the CRT controller 42 controls the display in unit of one character. This might introduce such a situation that the horizontal scanning frequency cannot be synchronized with the chrominance subcarrier frequency within the personal computer, as hereinafter described in greater detail.

It is assumed that the total number of dots arranged during one horizontal scanning period including a horizontal scanning display period and a horizontal scanning retrace period is 455. It is also assumed that one character is comprised of 8×8 dot matrix. Dividing 455 by 8 yields a remainder of 7 (455÷8=56 . . . 7). Thus, in this case, it is impossible for the CRT controller 42 to control the last seven dots, thereby causing a deviation of the horizontal scanning frequency from the normal frequency. As such, it will not be synchronized with the chrominance subcarrier frequency. In ordinary color television signals, the chrominance subcarrier frequency $f_s$ and the horizontal scanning frequency $f_H$ have the following relation:

$$f_s=(f_H/2)\times 455$$

where $f_s$=3.57945 MHz, and $f_H$=15734.264 Hz. If the aforementioned slight deviation of the frequency $f_H$ occurs and the above-mentioned relation is not satisfied, then the colors of the characters displayed on the CRT 33 may differ from the actual colors desired. This difficulty can be avoided by the embodiment described next.

Figure 9:
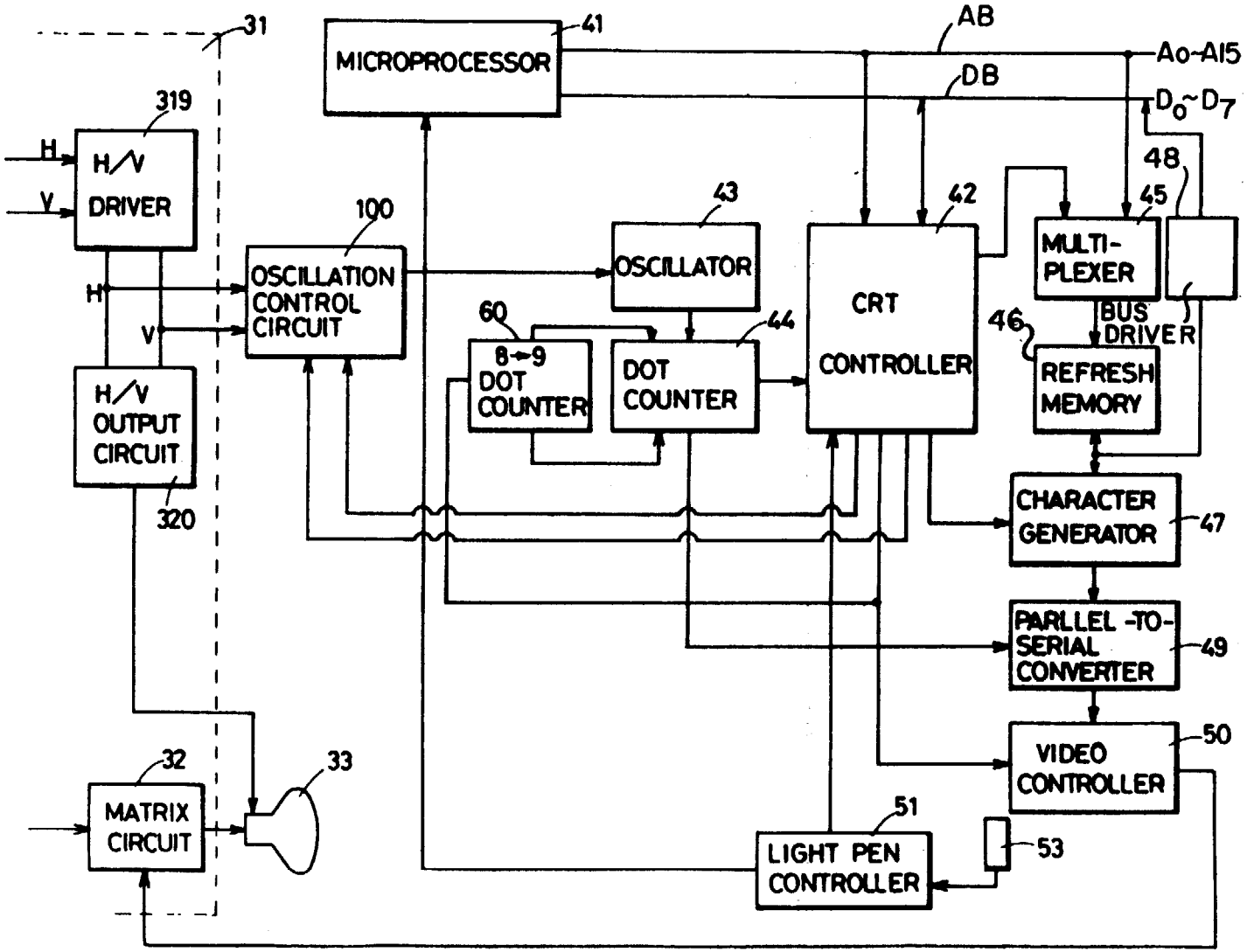
FIG. 9 is a schematic block diagram of yet another CRT control device of the invention.
Figure 10:
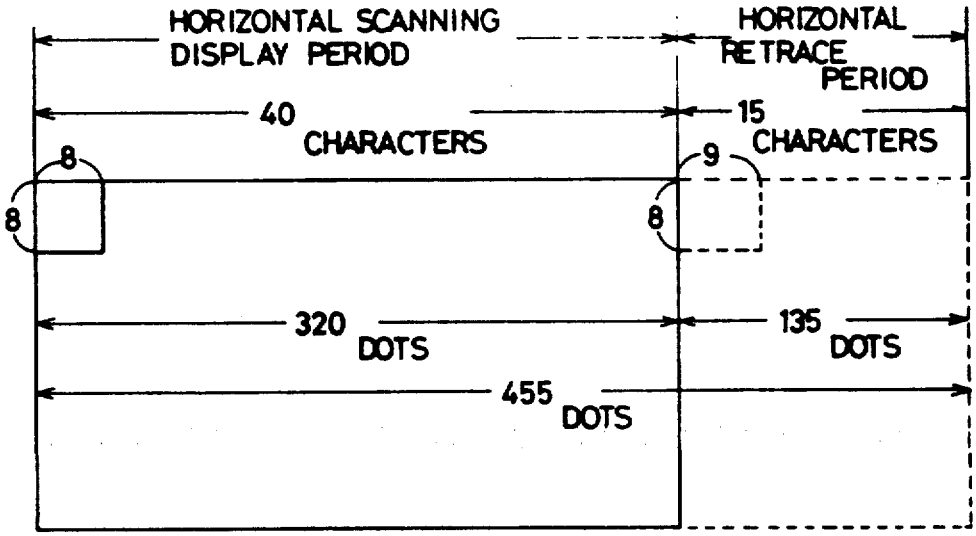
FIG. 10 illustrates the operation of the device of FIG. 9.

FIG. 9 is a schematic block diagram showing still another embodiment of the invention, and FIG. 10 illustrates the principal operations of the configuration of FIG. 9. The configuration of FIG. 9 is similar to the configuration of FIG. 3 except for the respect described below, and the similar components are denoted by like reference numerals and will not be described hereinafter. The configuration of FIG. 9 is characterized by the provision of a dot converter circuit 60 in association with dot counter 44. The converter circuit 60 acts to change the rate of frequency division of the counter 44 in response to the horizontal display timing signal (DISPTMG) from the CRT controller 42.

The operation of the configuration of FIG. 9 is now described with reference to FIG. 10. When the horizontal display timing signal fed from the CRT controller 42 to the dot converter circuit 60 is in high level state, that is, it is in a horizontal scanning display period, the converter circuit 60 causes the counter 44 to take its normal submultiple of frequency division. In particular, the counter 44 provides one clock signal to the controller 42 for every eight horizontal dots. In the meantime, the counter 44 delivers eight dot timing signals to parallel-to-serial converter circuit 49. Thus, one horizontal array of character data of 8×8 dot matrix read from the refresh memory 46 is displayed on the CRT 33 in the ordinary manner.

When the display timing signal from the CRT controller 42 makes a transition to low level and it is in a horizontal retrace period, the dot converter circuit 60 changes the submultiple of frequency division of the dot counter 44 so that the counter 44 delivers one character clock to the controller 42 for every nine horizontal dots. Meanwhile, the counter 44 gives nine dot timing signals to the converter circuit 49. Since one character clock includes nine dots in this way, 135 dots in a horizontal retrace period are controlled just in synchronism with 15 character clocks, preventing deviation of the horizontal scanning frequency.

It is to be understood that the present invention can be applied to all the cases where a CRT controller exerts control over display in unit of one character but is unable to control all of the horizontal dots.

Figure 11:
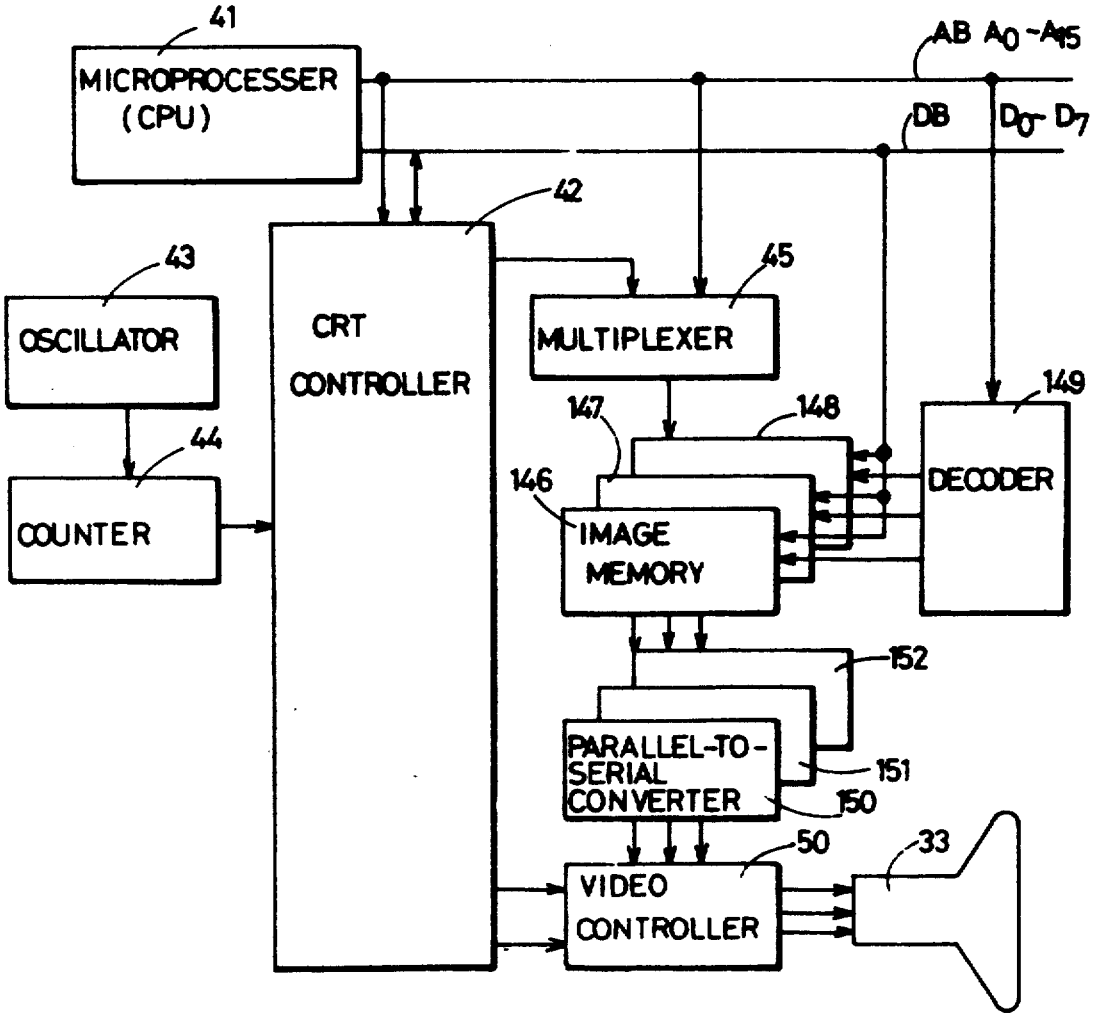
FIGS. 11 and 13 are schematic block diagrams of further CRT control devices of the invention.

Referring next to FIG. 11, there is shown yet a further CRT display control device of the invention in schematic block diagram, in which image memories 146, 147, and 148 are provided to store red, green, and blue picture element data, respectively, for displaying color characters, graphs, or the like on CRT 33. If one TV picture is comprised of 320×200 dots, for example, the memories 146–148 each consist of a 8K byte memory. A decoder 149 decodes the address signal, which is supplied to it through address bus AB, and selects these memories 146–148. The red, green, and blue picture element data which take bit parallel form and are fetched from the memories 146–148 are converted into the signals in bit serial form by parallel-to-serial converter circuits 150–152, and then they are fed to a video controller 50, which also receives horizontal and vertical synchronizing signals from a CRT controller 42. Thus, the video controller 50 supplies image data in bit serial form to a CRT display 33 in response to the horizontal and vertical synchronizing signals for displaying desired characters, graphs, or the like thereon.

Figures 12, 13:
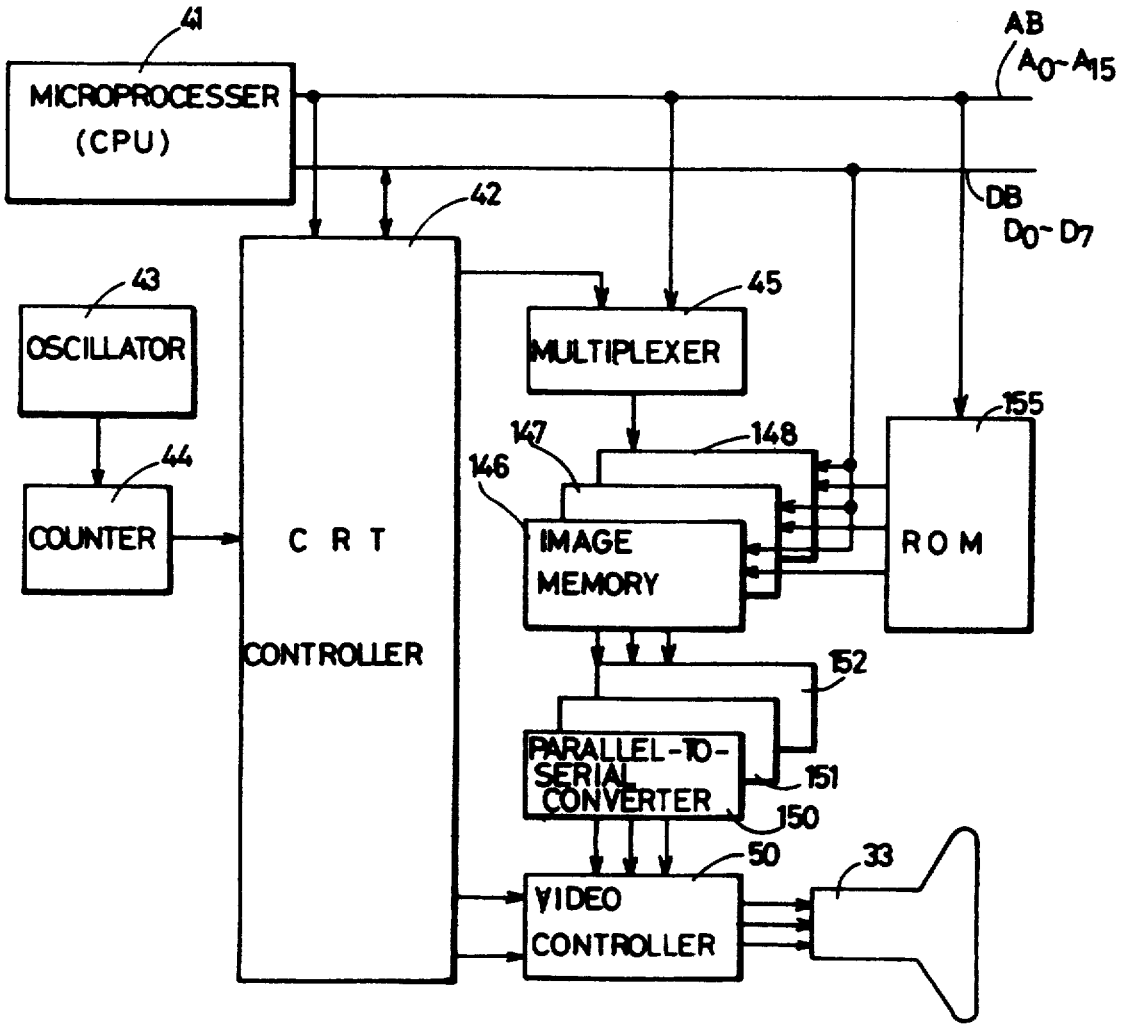
FIGS. 12 and 14 show the selecting signals delivered from the decoders and the ROMs of FIGS. 11 and 13, respectively.

FIG. 12 is a table illustrating the decoded signals delivered from decoder 149 shown in FIG. 11. Next, the operation of the configuration of FIG. 11 is described with reference to FIG. 10. In order to display a color image at an arbitrary point on CRT 33, it :s required that the red, green, and blue picture element data fetched from the image memories 146–148 be given to the CRT 33 and that these data be superimposed on one another for presentation. For this purpose, the red, green, and blue picture element data are read by specifying predetermined addresses in the memories 146–148. More specifically, multiplexer 45 is first connected to address bus AB so as to be coupled to CPU 41, thus allowing the address signals produced from the CPU 41 to be supplied to the memories 146–148. At the same time, decoder 149 decodes select signal "000" constituting a portion of the address signals to select the memory 146 corresponding to red picture elements. In this case, the memories 147 and 148 corresponding to green and blue picture elements are not selected. Accordingly, the red picture element data delivered from the CPU 41 over the data bus DB is stored in the memory 146. Then, the decoder 149 selects the memory 147 to write the green picture element data into the memory. Next, the decoder 149 selects the memory 148 so that the blue picture element data is stored in the memory. More specifically, the image memories 146–148 are made of a single memory in which addresses 0 through 7,999 form a red picture element memory, addresses 8,000 through 15,999 form a green picture element memory, and addresses 16,000 through 23,999 form a blue picture element memory, for instance. If it is desired that a black point or area be displayed on the CRT 33, then 0 is written into addresses 0 through 7,999, addresses 8,000 through 15,999, and addresses 16,000 through 23,999.

When it is desired that the data stored in the memories 146–148 be displayed on the CRT 33, the multiplexer 45 is connected to the CRT controller 42. Then, when the decoder 149 selects the image memory 146 in the same way as the foregoing case, red picture element data is supplied to the video controller 50 via the converter circuit 150. Next, as the decoder selects the memory 147, green picture element data is provided to the video controller 50 via the converter circuit 151. Thereafter, the decoder selects the memory 148, at which time blue picture element data is fed to the video controller 50 via the converter circuit 152. Then, the controller 50 gives the red, green, and blue picture element data it has received to the CRT 33, so that these data are superimposed on one another to display an image having a desired color or colors.

It is to be noted that the image memories 146–148 for storing red, green, and blue picture element data are individually selected by the decoder 149 to retrieve these data, whereby a long time is necessary for these processings, leading to a decrease in the efficiency of the CPU 41, in the embodiment described just above.

To circumvent this problem, a still other embodiment described below has three image memories for storing red, green, and blue picture elements, respectively, and also an addressing means for simultaneously specifying addresses of at least two of the three memories in response to an input address signal produced from an address signal generating means.

Figures 14, 15:
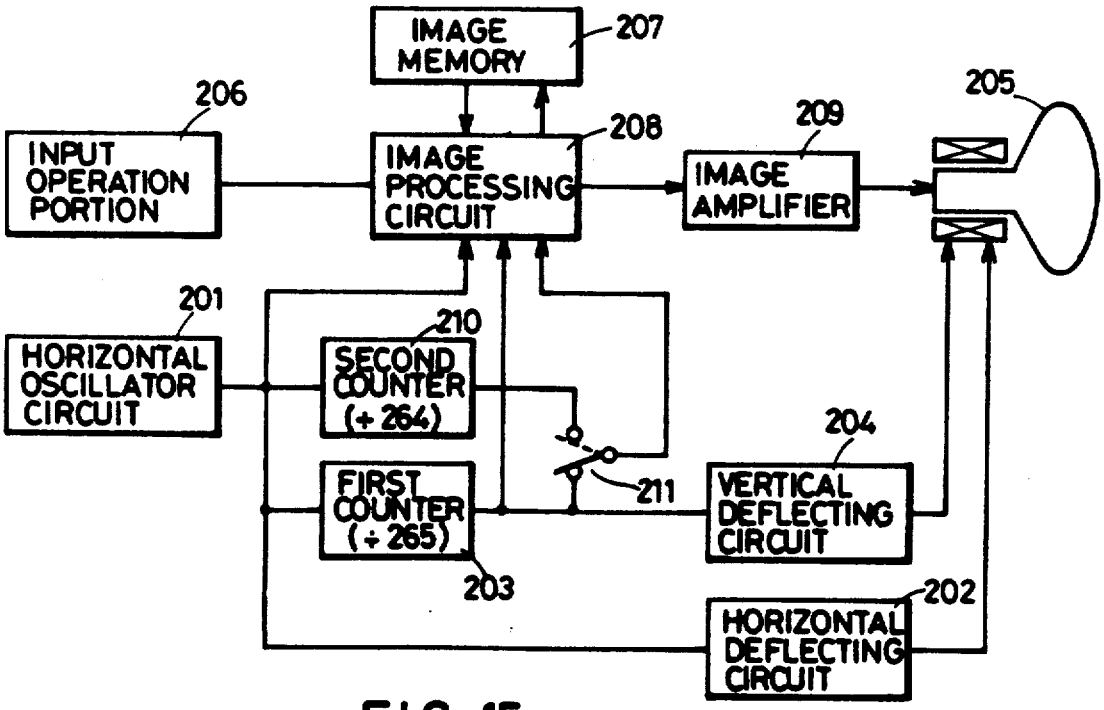
FIG. 15 is a schematic block diagram of a yet further CRT control device of the invention.
Figure 16A:
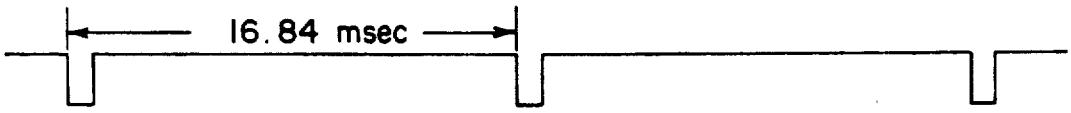
FIG. 16 (*a*)–(*d*) is a time chart illustrating the operation of the device of FIG. 15.
Figure 16B:
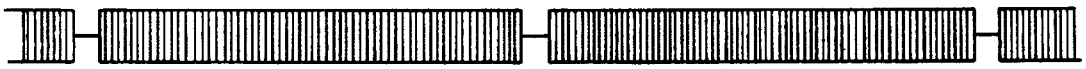
Figure 16C:
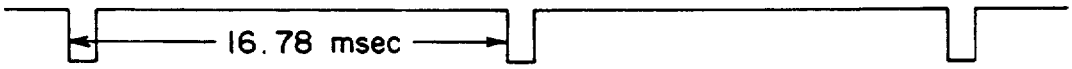
Figure 16D:
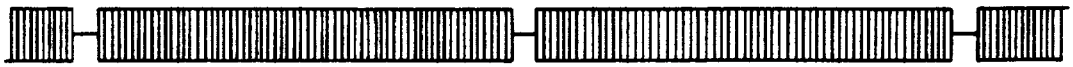

FIG. 13 is a schematic block diagram of such an embodiment, and FIG. 14 is a table illustrating the select signals delivered by a read-only memory 155 shown in FIG. 13.

In the example shown in FIG. 11, the image memories 146–148 are individually selected by the decoder 149. The embodiment shown in FIG. 13 is similar to the embodiment of FIG. 11 except that the decoder 149 is replaced by the read-only memory 155. A program has been already loaded into the ROM 155 so that it may select one of the memories 146–148, or select all the memories simultaneously in response to the select signals as shown in FIG. 14. When all of the memories 146–148 are to be accessed simultaneously, the multiplexer 45 is coupled to the CPU 41 for causing the CPU to supply address signals including select signal "111" to the ROM 155, which then delivers select signals to select the memories 146–148 simultaneously. Accordingly, predetermined addresses of these memories 146–148 are simultaneously specified, thus allowing these addresses to write data produced from the CPU 41 thereinto. When data are read from the memories 146–148, the multiplexer 45 is connected to the CRT controller 142 to cause the ROM 155 to produce select signals for selecting all of the memories 146–148 at the same time. As a result, red, greed, and blue picture element data are read from those memories.

According to the aforementioned embodiment, addresses of at least two of the three image memories are specified concurrently and therefore the time required to access the memories can be reduced.

In conventional CRT display apparatuses, when a picture image on a screen is shifted one line upward or downward, or scrolled, the information previously stored in an image memory having a storage capacity equivalent one picture are cyclically replaced with one another with a certain period. For example, the information about the first line in the memory is first erased, and then the information relative to the second line is written into the addresses of the memory corresponding to the first line. The information concering the third line is then written into the addresses of the memory corresponding to the second line. In the same manner, information regarding the succeeding lines are written into the addresses of the memory in succession. Then, by repeatedly reading each piece of information cyclically written into the memory from it in synchronism with the raster scan of the CRT, the picture image on the screen can be seen to scroll or move upward with a certain period.

In the above-described conventional scrolling, every one line movement needs replacement of all the information in the image memory, thereby limiting the scrolling velocity.

In view of the foregoing, yet another embodiment is provided in which image information such as characters displayed on the CRT of a television receiver in overlapping relation to the picture of a broadcast can be readily scrolled using a simple circuit configuration, as described hereinafter.

Referring next to FIG. 15, there is shown such an embodiment in block diagram ,in which a horizontal oscillator circuit 201 produces horizontal pulses of 15.734 KHz, for example, to a horizontal deflecting circuit 202. A first counter 203 divides the horizontal pulses of 15.734 KHz from the oscillator circuit 201 by a factor of 1/265, for example, down into vertical pulses of 59.37 KHz, which drives a vertical deflecting circuit 204. A cathode-ray tube 205 is supplied with the horizontal and vertical deflecting signals from the deflecting circuits 202 and 204 to effect ordinary deflecting operation. Information such as characters, figures, or the like to be displayed on the screen of the CRT is entered by operating an input operation portion 206 and stored in an image memory 207, which has a storage capacity equivalent to at least one picture on the screen. An image processing circuit 208 receives an input signal from the input operation portion 206 to write image information into the memory 207 or read it from the memory in synchronism with the aforementioned horizontal and vertical pulses. An image amplifier 209 amplifies the read image signal and supplies it to the CRT 205.

The aforementioned components 201-209 form an ordinary CRT display apparatus, to which a second counter 210 and a changeover switch 211 are added. The second counter have a factor of frequency division slightly different from that (1/265) of the first counter 203. As an example, when image information such as characters, or the like now displayed on the screen of the CRT is slowly scrolled upward, the factor of frequency division of the second counter 210 may be set to 1/264, for example.

In the CRT display apparatus constructed as described above, when a stationary image is to be displayed on the screen of the CRT, the vertical pulses, which are obtained from the first counter 203 and shown in FIG. 16 (*a*), are supplied to the image processing circuit 208 as reading timing signals via the switch 211. At this time, each piece of image information as shown in FIG. 16 (*b*) is read in succession from the memory 207 in synchronism with the vertical pulses and accordingly in synchronism with the vertical scan of the CRT 205. Thus, a still image is continued to be displayed on the screen of the CRT.

When the switch 211 is connected to the output of the second counter 210, reading timing signals, which have a period of 16.78 ms shorter than that (16.84 ms) of the vertical pulses by one line and are shown in FIG. 16 (*c*), are obtained from the counter 210 through the switch 211. These timing signals cause image signals as shown in FIG. 16 (*d*) to be supplied in succession from the memory 207 to the image processing circuit 208. Then, the signals are amplified by a video amplifier 209 and supplied to the CRT 205. As a result, the image information presently displayed on the screen is slowly moved upwardly, thus achieving a scrolling representation.

In order to increase the scrolling velocity on the screen, the factor of frequency division of the second counter 210 is set to 1/263 or 1/262, for example. If it is desired that the image information on the screen be moved downward, the factor of frequency division of the second counter is set to 1/266 or 1/267, for example, that is smaller than the factor of the frequency division (1/265) of the first counter 3.

In the novel CRT display apparatus described above, a scroll display can readily be attained on the screen without the need to replace each piece of information stored in the image memory with one another by virtue of the addition of the second counter whose factor of frequency division is set to be slightly different from that of the first vertical counter, the second counter delivering timing signals to give access to the image memory. In other words, data which is derived from a personal computer and is displayed on the screen in superimposing relation to the picture of a television broadcast can easily be scrolled.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A system for superimposing information from an electronic processing device onto a television broadcast being displayed on a display screen of a television receiver, comprising:

a television receiver including display means for displaying a television broadcast and information;

data processing means for generating actual data and information; and control means, operatively connected to said television receiver and said data processing means, for controlling an exchange of data between said television receiver and said data processing means;

said control means including, storage means, operatively connected to said data processing means, for storing said actual data and information from said processing means, said actual data and information to be displayed on said display means, oscillator means, operatively connected to said television receiver, for producing clock signals in synchronism with horizontal and vertical synchronizing signals developed by said television receiver, timing means, operatively connected to said oscillator means, for defining a horizontal scanning display period, a horizontal scanning retrace period, a vertical scanning display period, and a vertical retrace period corresponding to said clock signals, and transfer means, operatively connected to said storage means and said display means, for transferring said actual data and information stored in said storage means to said display means in response to said timing means;

said timing means providing a signal representing said vertical retrace period to said data processing means;

said data processing means generating said actual information and data to be displayed on said display means when said signal representing said vertical retrace period is received from said timing means;

said timing means developing a character timing signal, said character timing signal including a plurality of character representation pulses each representative of a character having a predetermined number of display dots, each plurality of character representation pulses having a frequency distinct from a chrominance subcarrier frequency of a broadcast signal being supplied to said television receiver;

said timing means including, count means for counting said character representation pulses, and modification means, operatively connected to said count means, for modifying the count of said count means so as to alter a length of said character representation pulses developed during each horizontal retrace period so that the chrominance subcarrier frequency is a multiple frequency of a frequency of all of said character representation pulses developed during both said horizontal scanning retrace period and said horizontal scanning display period.

* * * * *